US007523748B2

(12) United States Patent
Hirano et al.

(10) Patent No.: US 7,523,748 B2
(45) Date of Patent: Apr. 28, 2009

(54) BLOW-BY GAS PROCESSING APPARATUS

(75) Inventors: Satoshi Hirano, Nagoya (JP); Naoya Okada, Kasugai (JP); Jun Ikeda, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 64 days.

(21) Appl. No.: 11/905,836

(22) Filed: Oct. 4, 2007

(65) Prior Publication Data

US 2008/0083399 A1 Apr. 10, 2008

(30) Foreign Application Priority Data

Oct. 6, 2006 (JP) ..... 2006-275155
Mar. 19, 2007 (JP) ..... 2007-070594

(51) Int. Cl.
*F01M 13/00* (2006.01)
*F01M 13/02* (2006.01)

(52) U.S. Cl. ..... 123/572

(58) Field of Classification Search ..... 123/572–574, 123/559.1

See application file for complete search history.

(56) References Cited

U.S. PATENT DOCUMENTS

| | | | | |
|---|---|---|---|---|
| 4,901,703 | A | 2/1990 | Humphries | |
| 4,962,745 | A * | 10/1990 | Ohno et al. | 123/533 |
| 5,456,239 | A * | 10/1995 | Henderson et al. | 123/563 |
| 6,691,687 | B1 * | 2/2004 | Liang et al. | 123/572 |
| 2002/0046743 | A1 | 4/2002 | Moren | |
| 2003/0106543 | A1 | 6/2003 | Gschwindt et al. | |
| 2003/0140909 | A1 | 7/2003 | Criddle et al. | |
| 2006/0243258 | A1 | 11/2006 | Withrow et al. | |
| 2007/0028903 | A1 | 2/2007 | Bruchner et al. | |
| 2007/0199550 | A1 | 8/2007 | Lindmark et al. | |

FOREIGN PATENT DOCUMENTS

| | | |
|---|---|---|
| DE | 20 2004 011 882 U1 | 12/2005 |
| DE | 10 2006 054 117 A1 | 5/2008 |
| JP | A-57-26218 | 2/1982 |
| JP | U-62-150514 | 9/1987 |
| JP | U 5-87213 | 11/1993 |
| JP | A 2004-60475 | 2/2004 |
| JP | A-2005-42681 | 2/2005 |
| JP | A 2006-144686 | 6/2006 |
| JP | A 2006-250080 | 9/2006 |
| WO | WO 99/61761 A1 | 12/1999 |

* cited by examiner

*Primary Examiner*—M. McMahon
(74) *Attorney, Agent, or Firm*—Oliff & Berridge, PLC

(57) ABSTRACT

An intake passage has an upstream portion in an upstream side of a supercharger, an intermediate portion between a supercharger and a throttle valve, and a downstream portion in a downstream side of the throttle valve. A first breather passage connects an interior of an engine with the downstream portion. A second breather passage connects the interior of the engine with the upstream portion. Introduction passages communicate the upstream portion with the interior of the engine at a non-supercharging time, and connect at least one of the intermediate portion and the downstream portion with the interior of the engine at a supercharging time. Thus, the interior of the engine is efficiently ventilated.

15 Claims, 11 Drawing Sheets

BLOW-BY GAS PROCESSING APPARATUS

BACKGROUND OF THE INVENTION

The present invention relates to a blow-by gas processing apparatus which is applicable to an internal combustion engine provided with a supercharger.

A vehicle internal combustion engine can be provided with, for example, a blow-by gas processing apparatus. The blow-by gas processing apparatus recirculates a combustion gas leaking to a crank chamber from a gap between a cylinder and a piston of the engine, that is, a blow-by gas to an intake passage. Specifically, an intake negative pressure generated in a portion of the intake passage in a downstream side of a throttle valve draws the blow-by gas in an interior of the engine so as to circulate in a breather passage. The blow-by gas is returned to the intake passage from the breather passage, is again fed to the combustion chamber, and is burned. Accordingly, it is possible to reduce a discharge amount of a hydrocarbon (HC) to the atmosphere. Further, it is possible to inhibit the blow-by gas from deteriorating oil in the engine. As mentioned above, the blow-by gas processing apparatus ventilates the interior of the engine.

In the case that the supercharger is provided in the internal combustion engine, if the supercharger is operated, the intake negative pressure is lost.

Japanese Laid-Open Utility Model Publication No. 5-87213, Japanese Laid-Open Patent Publication No. 2006-144686 and Japanese Laid-Open Patent Publication No. 2004-60475 each disclose a blow-by gas processing apparatus which is applicable to an internal combustion engine provided with a supercharger.

As shown in FIG. 12, the blow-by gas processing apparatus disclosed in Japanese Laid-Open Utility Model Publication No. 5-87213 is provided with an introduction passage 101, a first breather passage 102, and a second breather passage 103. An intake passage 105 is provided with an upstream portion 105*a* which is provided on an upstream side of a compressor 106*a* of a supercharger 106, an intermediate portion 105*b* which is provided between the compressor 106*a* and a throttle valve 109, and a downstream portion 105*c* which is provided on a downstream side of the throttle valve 109. The introduction passage 101 connects the upstream portion 105*a* with an interior of a head cover 104 of the engine 100. The introduction passage 101 is provided with a check valve 107. The first breather passage 102 connects an interior of a crankcase 108 with the downstream portion 105*c*. The first breather passage 102 is provided with a positive crankcase ventilation valve (a PCV valve) 110. The second breather passage 103 connects the interior of the crankcase 108 with the upstream portion 105*a*. The second breather passage 103 is provided with a check valve 111.

In the case that the supercharger 106 is not operated, that is, at a non-supercharging time, an intake negative pressure is generated in the downstream portion 105*c*. Accordingly, as shown by filled-in arrows in FIG. 12, the blow-by gas in the engine 100 flows through the first breather passage 102 and is drawn (recirculated) into the intake passage 105. In the same manner, as shown by the filled-in arrows, an intake air flows through the introduction passage 101 so as to flow into the interior of the engine 100, and makes the interior of the engine 100 close to the atmospheric pressure.

Further, in the case that the supercharger 106 is operated, that is, at a supercharging time, the negative pressure is generated in the upstream portion 105*a*. As a result, as shown by open arrows in FIG. 12, the blow-by gas in the engine 100 can flow through the second breather passage 103 so as to be drawn into the intake passage 105.

However, in the blow-by gas processing apparatuses in the publications mentioned above, it is practically impossible to introduce the intake air into the interior of the engine at the supercharging time.

As shown in FIG. 13, the blow-by gas processing apparatus disclosed in Japanese Laid-Open Patent Publication No. 2006-144686 is provided with an introduction passage 121, a breather passage 122, and a common passage 123. An intake passage 124 is provided with an upstream portion 124*a* which is provided on an upstream side of a compressor 125*a* of a supercharger 125, an intermediate portion 124*b* which is provided between the compressor 125*a* and a throttle valve 126, and a downstream portion 124*c* which is provided on a downstream side of the throttle valve 126. The introduction passage 121 connects the intermediate portion 124*b* with a chain case 127 of the engine 120. The introduction passage 121 is provided with a check valve 128. The breather passage 122 connects an interior of a crankcase 129 with the downstream portion 124*c*. The breather passage 122 is provided with a PCV valve 130. The common passage 123 connects an interior of a head cover 131 with the upstream portion 124*a*.

At the non-supercharging time, an intake air existing within the upstream portion 124*a* flows through the common passage 123 so as to flow into the engine 120, and makes the interior of the engine 120 close to the atmospheric pressure. An intake negative pressure is generated in the downstream portion 124*c*. As a result, the blow-by gas in the engine 120 flows through the breather passage 122 so as to be drawn into the intake passage 124.

At the supercharging time, the intake air within the intermediate portion 124*b* flows through the introduction passage 121 so as to flow into the interior of the engine 120, thereby making the interior of the engine 120 higher pressure than the upstream portion 124*a*. Accordingly, the blow-by gas in the engine 120 flows through the common passage 123 so as to be drawn into the intake passage 124.

As a result, at both of the supercharging time and the non-supercharging time, the blow-by gas in the engine 120 is recirculated to the intake passage, and the intake air can be introduced to the interior of the engine 120. However, the blow-by gas flow in the engine 120 is different between the supercharging time and the non-supercharging time. Further, the intake air flow in the engine 120 is different between the supercharging time and the non-supercharging time. In other words, filled-in arrows and open arrows shown in FIG. 13 are directed to opposite directions to each other. As a result, the blow-by gas flow and the intake air flow are possibly disturbed in the engine 120 each time there is a switch between the supercharging time and the non-supercharging time. In other words, these flows can stagnate temporarily. Further, the blow-by gas discharged from the interior of the engine 120 can be again returned to the interior of the engine 120. Further, the intake air introduced to the interior of the engine 120 can be again returned to the outer portion. This can prevent an efficient ventilation of the interior of the engine 120. Particularly, in the case that the engine 120 is an in-vehicle internal combustion engine, the supercharging time and the non-supercharging time can be frequently switched in such a manner as to correspond to a change of the operating state of the engine 120. Accordingly, an efficient ventilation of the interior of the engine 120 is desired.

As shown in FIG. 14, the blow-by gas processing apparatus disclosed in Japanese Laid-Open Patent Publication No. 2004-60475 is provided with a first common passage 141 and a second common passage 142. An intake passage 143 is provided with an upstream portion 143*a* which is provided on an upstream side of a compressor 147*a* of a supercharger 147, an intermediate portion 143*b* which is provided between the compressor 147*a* and the throttle valve 144, and a downstream portion 143*c* which is provided on a downstream side of the throttle valve 144. The first common passage 141 connects an interior of an engine 140 with the downstream portion 143*c*. The first common passage 141 is provided with a PCV valve 145, and a bypass passage 146 bypassing the PCV valve 145. The second common passage 142 connects the interior of the engine 140 with the upstream portion 143*a*.

At the non-supercharging time, the intake negative pressure is generated in the downstream portion 143*c*. As a result, the blow-by gas in the engine 140 flows through the first common passage 141, and is drawn into the downstream portion 143*c*. The intake air within the upstream portion 143*a* flows through the second common passage 142 so as to flow into the interior of the engine 140.

At the supercharging time, the intake air within the downstream portion 143*c* flows through the first common passage 141 and the bypass passage 146, and flows into the interior of the engine 140. Since the negative pressure is generated by the supercharger 147 in the upstream portion 143*a*, the blow-by gas in the engine 140 flows through the second common passage 142 so as to be drawn into the intake passage 143.

In this case, as shown in FIG. 14, filled-in arrows and open arrows are directed to opposite directions to each other. In other words, the blow-by gas flow in the engine 140, and the intake air flow in the engine 140 are inverted between the supercharging time and the non-supercharging time. Accordingly, if the supercharging time and the non-supercharging time are switched frequently, the ventilation efficiency in the engine 140 is lowered.

SUMMARY OF THE INVENTION

An objective of the present invention is to provide a blow-by gas processing apparatus which can efficiently ventilate the interior of an engine.

In accordance with one aspect of the present invention, a blow-by gas processing apparatus applicable to an internal combustion engine is provided. An intake passage extends from the engine. An intake air flows from an upstream side to a downstream side in the intake passage, whereby the intake air flows toward the engine. A supercharger and a throttle valve are arranged in the intake passage. A throttle valve is positioned in a downstream side of the supercharger. The supercharger pressure feeds the intake air flowing through the intake passage toward the engine, thereby supercharging the intake air to the engine. The throttle valve variably sets a passage cross-sectional area of the intake passage. The intake passage has an upstream portion which is provided on an upstream side of the supercharger, an intermediate portion which is provided between the supercharger and the throttle valve, and a downstream portion which is provided on a downstream side of the throttle valve. The processing apparatus has a first breather passage, a second breather passage, and an introduction passage. The first breather passage connects the interior of the engine with the downstream portion. The first breather passage communicates with the interior of the engine in a first communicating portion. The first breather passage has a first one-way discharge valve allowing only a gas discharge from the interior of the engine to the intake passage. The second breather passage connects the interior of the engine with the upstream portion. The second breather passage communicates with the interior of the engine in a first communicating portion. The second breather passage has a second one-way discharge valve allowing only a gas discharge from the interior of the engine to the upstream portion. The introduction passage connects the upstream portion with the interior of the engine at the non-supercharging time, and connects at least one of the intermediate portion and the downstream portion with the interior of the engine at the supercharging time.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
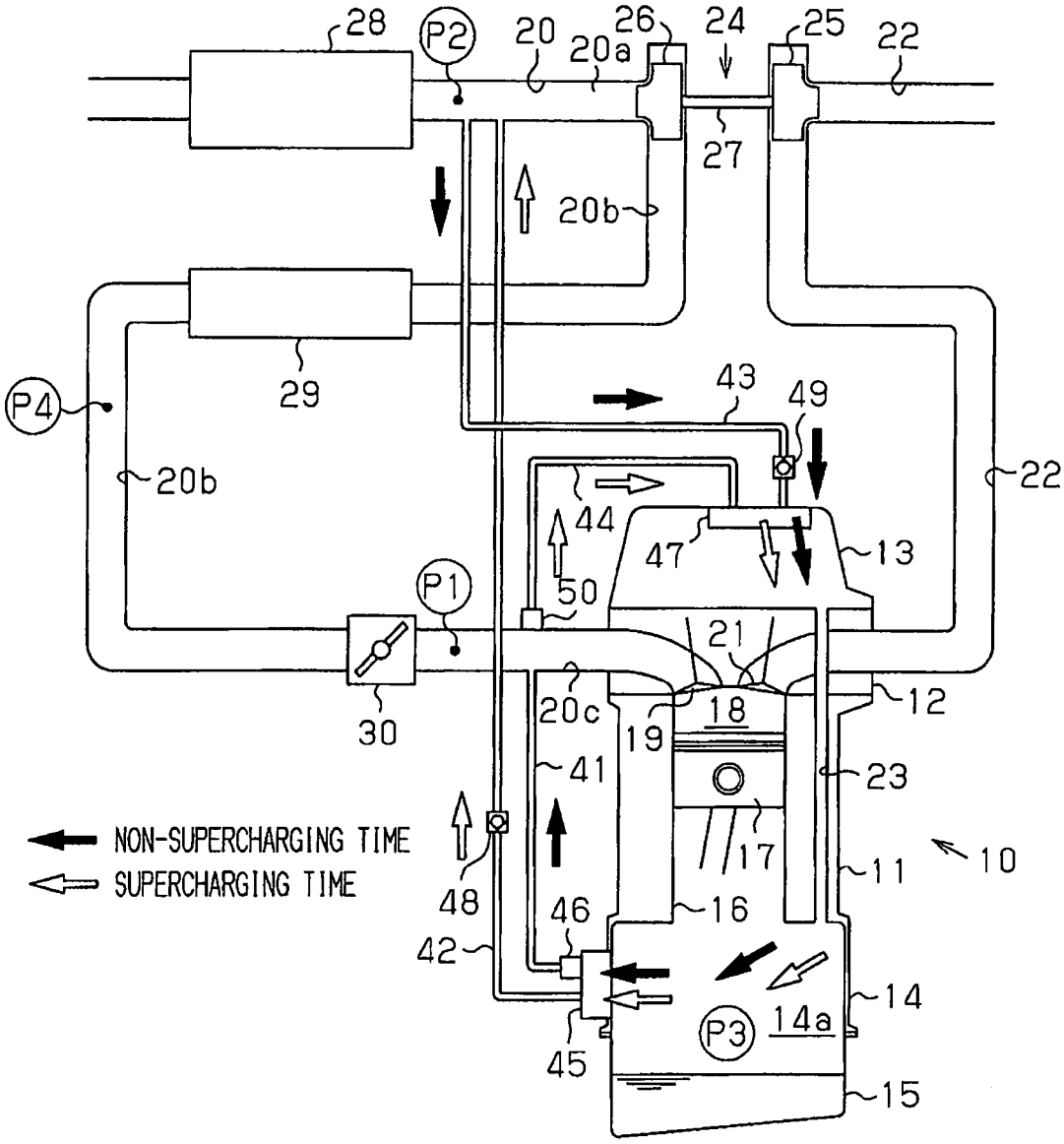
FIG. 1 is a schematic view of a blow-by gas processing apparatus in accordance with a first embodiment of the present invention.

FIG. 1 shows a first embodiment according to the present invention. A blow-by gas processing apparatus in accordance with a first embodiment is applied to an engine 10.

As shown in FIG. 1, the engine 10 is an internal combustion engine provided with a cylinder block 11. A cylinder head 12 is provided on an upper portion of the cylinder block 11, and a head cover 13 is installed to an upper portion of the cylinder head 12. A crankcase 14 is formed in a lower portion of the cylinder block 11, and an oil pan 15 is attached to a lower portion of the crankcase 14. Oil for lubricating the engine 10 is stored in the oil pan 15. Hereinafter, the interior of the engine 10 represents an interior of the head cover 13 and a crank chamber 14*a*.

A cylinder 16 is formed in the cylinder block 11. A piston 17 is arranged in the cylinder 16 so as to reciprocate. The engine 10 has a combustion chamber 18. An inner peripheral wall of the cylinder 16, a top surface of the piston 17, and a lower surface of the cylinder head 12 define the combustion chamber 18. An intake passage 20 is connected to the combustion chamber 18 via an intake valve 19, and an exhaust passage 22 is connected thereto via an exhaust valve 21. In other words, each of the intake passage 20 and the exhaust passage 22 extends from the engine 10. A communicating passage 23 is formed in the engine 10. The communicating passage 23 extends in such a manner as to communicate the interior of the head cover 13 with the crank chamber 14*a*.

One exhaust-driven supercharger 24 is provided in the intake passage 20 and the exhaust passage 22. The supercharger 24 is provided with a turbine wheel 25 provided in the exhaust passage 22, and a compressor impeller 26 provided in the intake passage 20. The shaft 27 couples the turbine wheel 25 to the compressor impeller 26 in such a manner as to be integrally rotatable.

If the amount of the exhaust gas flowing through the exhaust passage 22 becomes large so as to be sprayed to the turbine wheel 25, the turbine wheel 25 and the compressor impeller 26 are integrally rotated. Accordingly, the intake air flowing through the intake passage 20 is forcibly pressure fed to the combustion chamber 18. In other words, the supercharger 24 supercharges the intake air to the combustion chamber 18. The supercharger 24 is not operated in the case that a load of the engine 10 is close to zero (work load≈0), and is operated in the case that the load of the engine 10 is large (work load>>0). In other words, the supercharger 24 is not operated in the case that the amount of the exhaust gas flowing through the exhaust passage 22 is small, and is operated in the case that the amount of the exhaust gas is large.

The intake air flows from an upstream side to a downstream side in the intake passage 20, whereby the intake air flows toward the engine 10. In other words, the intake air in the intake passage 20 flows from an upstream side in an intake air flowing direction toward a downstream side, thereby moving toward the engine 10. From the upstream side toward the downstream side in the intake passage 20, an air cleaner 28, the compressor impeller 26, an intercooler 29, and a throttle valve 30 are arranged in this order. The air cleaner 28 filtrates the intake air. The intercooler 29 lowers a temperature of the intake air by executing a heat exchange between the intake air and the external ambient atmosphere. The throttle valve 30 is a throttle valve variably setting a passage cross-sectional area of the intake passage 20. The turbine wheel 25 is arranged in the exhaust passage 22.

The intake passage 20 has an upstream portion 20*a*, an intermediate portion 20*b* and a downstream portion 20*c*. The upstream portion 20*a* corresponds to a portion of the intake passage 20 between the air cleaner 28 and the supercharger 24. In other words, the upstream portion 20*a* corresponds to a portion of the intake passage 20 in an upstream side of the supercharger 24. The intermediate portion 20*b* corresponds to a portion of the intake passage 20 between the supercharger 24 and the throttle valve 30. In other words, the upstream portion 20*a* and the intermediate portion 20*b* correspond to a portion of the intake passage 20 in an upstream side of the throttle valve 30. The downstream portion 20*c* corresponds to a portion of the intake passage 20 in a downstream side of the throttle valve 30. A pressure of the upstream portion 20*a* is referred to as an upstream pressure P2, and a pressure of the downstream portion 20*c* is referred to as a downstream pressure P1. A pressure in the engine 10 is referred to as engine internal pressure P3. In other words, the engine internal pressure P3 indicates a pressure in the head cover 13 and the crank chamber 14*a*. A pressure of the intermediate portion 20*b* is referred to as an intermediate pressure P4. The state in which the downstream pressure P1 is made higher than the atmospheric pressure by the operation of the supercharger 24 is referred to as "supercharging time", and the state in which the downstream pressure P1 is lower than the atmospheric pressure is referred to as "non-supercharging time."

Combustion gas in the combustion chamber 18 passes through a gap of sliding surfaces between the cylinder 16 and the piston 17, and leaks to the crank chamber 14*a*. The combustion gas leaking as mentioned above corresponds to a blow-by gas. Hereinafter, the blow-by gas leaking to the crank chamber 14*a* from the combustion chamber 18 may be referred to as a leaked blow-by gas. The engine 10 is provided with a blow-by gas processing apparatus recirculating the blow-by gas to the intake passage 20.

The blow-by gas processing apparatus is provided with a first breather passage 41, a second breather passage 42, a first introduction passage 43, and a second introduction passage 44. Each of the first breather passage 41 and the second breather passage 42 recirculates the blow-by gas in the crank chamber 14*a* to the intake passage 20. In other words, the blow-by gas in the engine 10 passes through the first breather passage 41 or the second breather passage 42, and is recirculated to the intake passage 20. Each of the first introduction passage 43 and the second introduction passage 44 introduces an intake air of the intake passage 20 into the interior of the head cover 13. In other words, the intake air in the intake passage 20 passes through the first introduction passage 43 or the second introduction passage 44, and flows into the interior of the engine 10.

The first breather passage 41 connects the crank chamber 14*a* with the downstream portion 20*c*. A first positive crankcase ventilation (PCV) valve 46 is arranged in the first breather passage 41.

The first PCV valve 46 corresponds to a one-way valve, and a differential pressure valve. In the case that the pressure in the crank chamber 14*a*, that is, the engine internal pressure P3 is higher than the downstream pressure P1, the more increased the pressure difference between them, the more reduced the opening degree of the first PCV valve 46 becomes. In the case that the engine internal pressure P3 is equal to or less than the downstream pressure P1, the first PCV valve 46 is closed. The first PCV valve 46 corresponding to the first one-way discharge valve allows the blow-by gas in the crank chamber 14*a* to recirculate to the intake passage 20, however, inhibits the intake air within the intake passage 20 from flowing into the crank chamber 14*a*. As mentioned above, the first PCV valve 46 autonomously regulates a flow rate of the blow-by gas passing through the first breather passage 41 on the basis of the pressure difference between the crank chamber 14*a* and the downstream portion 20*c*.

A first oil separator 45 is arranged in the crankcase 14. The first oil separator 45 separates oil mist from the blow-by gas. The first PCV valve 46 is connected to the first oil separator 45. In other words, an inlet of the first breather passage 41 is connected to the crank chamber 14*a* via the first PCV valve 46 and the first oil separator 45. The first oil separator 45 corresponds to a portion of the engine 10 communicating with the first breather passage 41, that is, a first communicating portion. An outlet of the first breather passage 41 is connected to the downstream portion 20*c*.

The second breather passage 42 connects the crank chamber 14*a* with the upstream portion 20*a*. A first check valve 48 is provided in the middle of the second breather passage 42. The first check valve 48 corresponding to a second one-way discharge valve allows the blow-by gas in the crank chamber 14*a* to flow through the second breather passage 42 so as to recirculate to the intake passage 20, however, inhibits the intake air within the intake passage 20 from flowing through the second breather passage 42 so as to flow into the crank chamber 14*a*.

An inlet of the second breather passage 42 is connected to the first oil separator 45. In other words, both of the inlet of the first breather passage 41 and the inlet of the second breather passage 42 communicate with the first oil separator 45 serving as the first communicating portion.

The first introduction passage 43 connects the upstream portion 20*a* with the interior of the head cover 13. A check valve 49 is provided in the middle of the first introduction passage 43. The check valve 49 allows the intake air within the intake passage 20 to flow through the first introduction passage 43 so as to flow into the interior of the head cover 13, however, inhibits the blow-by gas in the head cover 13 from flowing through the first introduction passage 43 so as to be discharged to the intake passage 20. In other words, the check valve 49 corresponds to a first one-way introduction valve.

A second oil separator 47 separating oil mist from the blow-by gas is arranged in the head cover 13. An outlet of the first introduction passage 43 is connected to the second oil separator 47. In other words, the first introduction passage 43 communicates with the interior of the head cover 13 via the second oil separator 47. In other words, the second oil separator 47 corresponds to a second communicating portion serving as a portion of the engine 10 communicating with the first introduction passage 43.

The second introduction passage 44 connects the downstream portion 20*c* with the interior of the head cover 13. An inlet of the second introduction passage 44 is connected to the downstream portion 20*c* via the second PCV valve 50. An outlet of the second introduction passage 44 is connected to the second oil separator 47. In other words, both of the outlet of the first introduction passage 43 and the outlet of the second introduction passage 44 communicate with the second oil separator 47 serving as the second communicating portion.

The second PCV valve 50 corresponds to a one-way valve, and a differential pressure valve. The second PCV valve 50 corresponding to the one-way introduction valve allows the intake air in the downstream portion 20*c* to be introduced into the interior of the head cover 13, however, inhibits the blow-by gas in the head cover 13 from flowing out to the intake passage 20. In the case that the downstream pressure P1 is equal to or less than the engine internal pressure P3, the second PCV valve 50 is closed. In the case that the downstream pressure P1 is higher than the engine internal pressure P3, the more increased the pressure difference between them, the more reduced the opening degree of the second PCV valve 50 becomes. In other words, the more reduced the pressure difference between the engine internal pressure P3 and the downstream pressure P1, the more increased the opening degree of the second PCV valve 50 becomes. As mentioned above, the second PCV valve 50 autonomously regulates the flow rate of the intake air passing through the first breather passage 41 on the basis-of the pressure difference between the interior of the head cover 13 and the downstream portion 20*c*.

Next, a description will be given of an operation of the blow-by gas processing apparatus.

The intake air introduction into the interior of the head cover 13 passes through different paths respectively at the supercharging time and the non-supercharging time. The blow-by gas discharge from the crank chamber 14*a* passes through different paths respectively at the supercharging time and the non-supercharging time.

The filled-in arrows in FIG. 1 indicate the blow-by gas discharge path from the interior of the engine 10 and the intake air introduction path to the interior of the engine 10 at the non-supercharging time. The open arrows indicate the blow-by gas discharge path and the intake air introduction path at the supercharging time.

At the non-supercharging time, the downstream pressure P1 is lower than the atmospheric pressure, and the upstream pressure P2 is substantially equal to the atmospheric pressure. In other words, at the non-supercharging time, the downstream pressure P1 is lower than the upstream pressure P2 (P1<P2).

Accordingly, at the non-supercharging time, the intake air within the upstream portion 20*a* flows through the first introduction passage 43 so as to flow into the interior of the head cover 13. As a result, the engine internal pressure P3 is higher than the downstream pressure P1. The pressure difference between the engine internal pressure P3 and the downstream pressure P1 makes the blow-by gas in the engine 10 flow to the first breather passage 41 so as to recirculate to the intake passage 20.

In other words, at the non-supercharging time, the intake air within the first introduction passage 43 is introduced to the interior of the head cover 13, and the blow-by gas in the crank chamber 14*a* flows through the first breather passage 41 so as to be discharged to the intake passage 20. Accordingly, at the non-supercharging time, the interior of the engine 10 is ventilated.

At the non-supercharging time, if the opening degree of the throttle valve 30 is increased, the intake air amount of the engine 10 is also increased. As a result, a generating amount of the blow-by gas is also increased. If the opening, degree of the throttle valve 30 is increased, the downstream pressure P1 is increased. Accordingly, the pressure difference between the downstream pressure P1 and the upstream pressure P2 is reduced, and the pressure difference between the downstream pressure P1 and the engine internal pressure P3 is reduced in the same manner. As a result, the opening degree of the first PCV valve 46 is increased. Accordingly, the amount of the blow-by gas flowing through the first breather passage 41 so as to be recirculated to the downstream portion 20*c* from the interior of the engine 10 is ensured. Therefore, the first PCV valve 46 accurately regulates the discharge amount of the blow-by gas from the interior of the engine 10 in correspondence to the generating condition of the blow-by gas.

On the other hand, the downstream pressure P1 is equal to or higher than the atmospheric pressure, and the upstream pressure P2 is lower than the atmospheric pressure. In other words, at the supercharging time, the upstream pressure P2 is lower than the downstream pressure P1 (P2<P1).

Accordingly, at the supercharging time, the blow-by gas in the crank chamber 14*a* passes through the second breather passage 42, and is recirculated to the upstream portion 20*a*. As a result, the engine internal pressure P3 is lower than the downstream pressure P1 (P3<P1). Therefore, the intake air in the downstream portion 20*c* flows through the second introduction passage 44 so as to flow into the interior of the head cover 13.

In other words, at the supercharging time, the intake air within the downstream portion 20*c* flows through the second introduction passage 44 so as to be introduced to the interior of the head cover 13. The blow-by gas in the crank chamber 14*a* flows through the second breather passage 42 so as to be discharged to the upstream portion 20*a*. As a result, at the supercharging time, the interior of the engine 10 is also ventilated.

The pressure difference between the downstream pressure P1 and the engine internal pressure P3 is changed in correspondence to the operating state of the supercharger 24. The generating amount of the blow-by gas in the engine 10 is also changed in correspondence to the operating state of the supercharger 24. Since the opening degree of the second PCV valve 50 is changed in correspondence to the pressure difference between the downstream pressure P1 and the engine internal pressure P3, the second PCV valve 50 regulates the intake air introducing amount to the interior of the engine 10 in such a manner as to match to the generating condition of the blow-by gas.

In accordance with the present embodiment, at both of the supercharging time and the non-supercharging time, the blow-by gas in the engine 10 is recirculated to the intake passage 20. Further, the intake air within the intake passage 20 is introduced to the interior of the engine 10 at both of the supercharging time and the non-supercharging time. Accordingly, the present embodiment efficiently ventilates the interior of the engine 10, for example, in comparison with the case wherein the blow-by gas discharge or the intake air introduction is not executed at the non-supercharging time or the supercharging time. Therefore, it is possible to suppress the discharge amount of a hydrocarbon (HC) to the atmosphere. Further, it is possible to suppress an oil deterioration caused by mixing of a fuel component in the blow-by gas. Further, it is possible to suppress an accumulation amount of oil sludge generated on the basis of the blow-by gas.

Both of the outlet of the first introduction passage 43 and the outlet of the second introduction passage 44 are connected to the head cover 13. Generally, if the blow-by gas deteriorates the oil, oil sludge is generated. Oil sludge can be generated in the crank chamber 14*a* and/or the interior of the head cover 13, and the oil sludge can be more easily generated in the interior of the head cover 13. Since the first introduction passage 43 and the second introduction passage 44 in accordance with the present embodiment can directly feed the intake air to the interior of the head cover 13, it is possible to suppress the generation of the oil sludge more efficiently.

Both of the first breather passage 41 and the inlet of the second breather passage 42 are connected to the crank chamber 14*a*. Accordingly, the intake air introduced to the interior of the head cover 13 from the first introduction passage 43 and the second introduction passage 44 efficiently pushes out the blow gas in the order of the interior of the head cover 13, the crank chamber 14*a*, and the intake passage 20. In other words, the entire interior of the engine 10 is efficiently ventilated.

In the case that the flowing direction of the blow-by gas discharged from the interior of the engine 10 is different between the supercharging time and the non-supercharging time, and the flowing direction of the intake air introduced to the interior of the engine 10 is further different between the supercharging time and the non-supercharging time, the blow-by gas flow in the engine 10 and the intake air flow in the engine 10 can become disturbed each time there is a switch between the operating state and the non-operating state of the supercharger 24. For example, the blow-by gas flow and the intake air flow in the engine 10 can stagnate temporarily. For example, in the case that the flowing direction of the blow-by gas in the engine 10, and the flowing direction of the intake air are switched in the opposite directions between the supercharging time and the non-supercharging time, the blow-by gas discharged from the interior of the engine 10 can be again returned to the interior of the engine 10. Further, the intake air introduced to the interior of the engine 10 can be again returned to the outer portion of the engine 10. In both of these cases, it is impossible to efficiently ventilate the interior of the engine 10. In other words, it is impossible to efficiently discharge the blow-by gas in the engine 10.

In the present embodiment, the flowing direction of the blow-by gas from the interior of the engine 10 toward the first breather passage 41 and the second breather passage 42 is always constant regardless of whether it is the supercharging time or the non-supercharging time. In the same manner, the flowing direction of the intake air flowing to the interior of the engine 10 from the first introduction passage 43 and the second introduction passage 44 is always constant regardless of whether it is the supercharging time or the non-supercharging time.

In the present embodiment, the inlet of the first breather passage 41, and the inlet of the second breather passage 42 are connected to the first oil separator 45 corresponding to the common portion (the same portion) in the engine 10. In other words, the blow-by gas in the engine 10 is always discharged to the outer portion from the first oil separator 45 with or without the operation of the supercharger 24. In other words, the blow-by gas in the engine 10 is discharged from the connecting portion of the first oil separator 45 in the crank chamber 14*a*. Further, both of the outlet of the first introduction passage 43 and the outlet of the second introduction passage 44 are connected to the second oil separator 47. In other words, the intake air is always introduced to the interior of the engine 10 from the second oil separator 47 with or without the operation of the supercharger 24. In other words, the intake air is introduced to the interior of the engine 10 from the connecting portion of the second oil separator 47 in the head cover 13. Accordingly, it is possible to fix each of the flowing direction of the blow-by gas in the engine 10 and the flowing direction of the intake air in the engine 10 with or without the operation of the supercharger 24. Accordingly, even if the operation is switched to the supercharging time and the non-supercharging time, the blow-by gas flow and the intake air flow in the engine 10 do not become largely disturbed. Therefore, the present embodiment can efficiently ventilate the interior of the engine 10.

The first embodiment has the following advantages.

(1) At the non-supercharging time, the intake air within the first introduction passage 43 is introduced to the interior of the head cover 13. The blow-by gas in the crank chamber 14*a* flows through the first breather passage 41 so as to be discharged to the intake passage 20. At the supercharging time, the intake air within the downstream portion 20*c* flows through the second introduction passage 44 so as to be introduced to the interior of the head cover 13. The blow-by gas in the crank chamber 14*a* flows through the second breather passage 42 so as to be discharged to the upstream portion 20*a*. Accordingly, the flow in the engine 10 is not changed between the supercharging time and the non-supercharging time, and it is possible to efficiently ventilate the blow-by gas in the engine 10.

(2) The second introduction passage 44 is provided with the second PCV valve 50. Accordingly, it is possible to regulate the intake air introducing amount to the interior of the engine 10 in such a manner as to match to the generating condition of the blow-by gas at the supercharging time.

(3) The first breather passage 41 is provided with the first PCV valve 46. Accordingly, it is possible to accurately regulate the discharge amount of the blow-by gas from the interior of the engine 10 in correspondence to the generating condition of the blow-by gas at the non-supercharging time.

The first embodiment may be modified as follows.

The structure is not limited to be made such that the first introduction passage 43 is provided with the check valve 49, and the first breather passage 41 is provided with the first PCV valve 46. Conversely, the structure may be made such that the first introduction passage 43 is provided with a PCV valve, and the first breather passage 41 is provided with a check valve. The PCV valve allows only the gas introduction from the intake passage 20 to the interior of the head cover 13. The check valve allows only the gas discharge from the crank chamber 14*a* to the intake passage 20.

Further, the structure may be made such that the first introduction passage 43 is provided with a PCV valve, and the first breather passage 41 is also provided with the first PCV valve 46. In other words, a PCV valve may be provided in at least one of the first introduction passage 43 and the first breather passage 41. These PCV valves regulate the blow-by gas discharge amount from the interior of the engine 10, and the intake air introducing amount to the interior of the engine 10 in correspondence to the blow-by gas generation status, on the basis of the pressure difference between the downstream pressure P1 and the upstream pressure P2, at the non-supercharging time.

The structure is not limited to be made such that the second introduction passage 44 is provided with the second PCV valve 50, and the second breather passage 42 is provided with the first check valve 48. Conversely, the structure may be made such that the second introduction passage 44 is provided with a check valve, and the second breather passage 42 is provided with a PCV valve. The check valve allows only the gas introduction from the intake passage 20 to the interior of the head cover 13. The PCV valve allows only the gas discharge from the crank chamber 14*a* to the intake passage 20. Further, the structure may be made such that the second introduction passage 44 is provided with the second PCV valve 50, and the second breather passage 42 is provided with another PCV valve. In other words, the PCV valve may be provided in at least one of the second introduction passage 44 and the second breather passage 42. The PCV valve regulates the blow-by gas discharge amount from the interior of the engine 10, and the intake air introducing amount to the interior of the engine 10, on the basis of the pressure difference between the downstream pressure P1 and the upstream pressure P2, at the supercharging time.

In the case that the second introduction passage 44 is provided with a check valve, the second introduction passage 44 may be further provided with an introduction limit valve. The introduction limit valve reduces a passage cross-sectional area of the second introduction passage 44 if the downstream pressure P1 is increased. The introduction limit valve inhibits the engine internal pressure P3 from being excessively increased due to the increase of the downstream pressure P1. Accordingly, it is possible to prevent a reliability of the seal member in the engine 10 from being lowered. The seal member prevents the gas outflow from the interior of the engine 10 to the outer portion, and prevents the gas from making an intrusion into the interior of the engine 10. In other words, the introduction limit valve can suppress the reduction of the reliability of the engine 10. The introduction limit value may be structured such as to shut off the second introduction passage 44 in the case that the downstream pressure P1 is equal to or more than a predetermined pressure, or may be structured such as to gradually reduce the opening degree of the second introduction passage as the downstream pressure P1 is increased.

Figure 2:
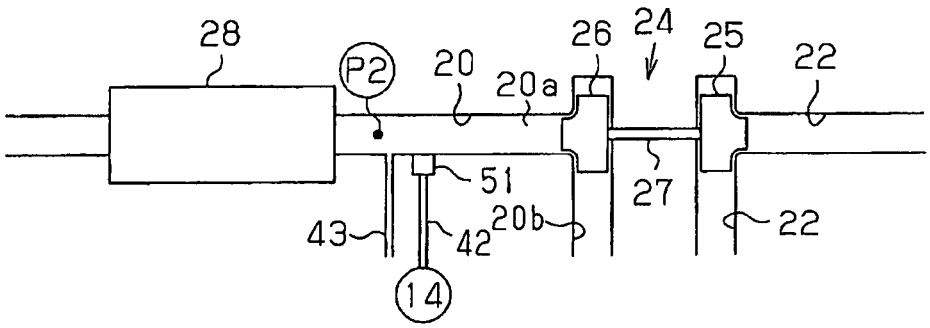
FIG. 2 is a schematic view of a blow-by gas processing apparatus in accordance with a second embodiment.

FIG. 2 shows a blow-by gas processing apparatus in accordance with a second embodiment of the present invention. The second embodiment has a discharge limit valve 51 provided in the second breather passage 42. The discharge limit valve 51 reduces a passage cross-sectional area of the second breather passage 42 if the upstream pressure P2 is lowered. The discharge limit valve 51 inhibits the engine internal pressure P3 from being excessively lowered due to the reduction of the upstream pressure P2, at the supercharging time. Accordingly, it suppresses the reduction of the reliability of the seal member in the engine 10. The discharge limit valve 51 may be structured such as to shut off the second breather passage 42 in the case that the upstream pressure P2 is equal to or less than the predetermined pressure, or may be structured such as to gradually reduce the opening degree of the second breather passage 42 as the upstream pressure P2 is lowered.

Figure 3:
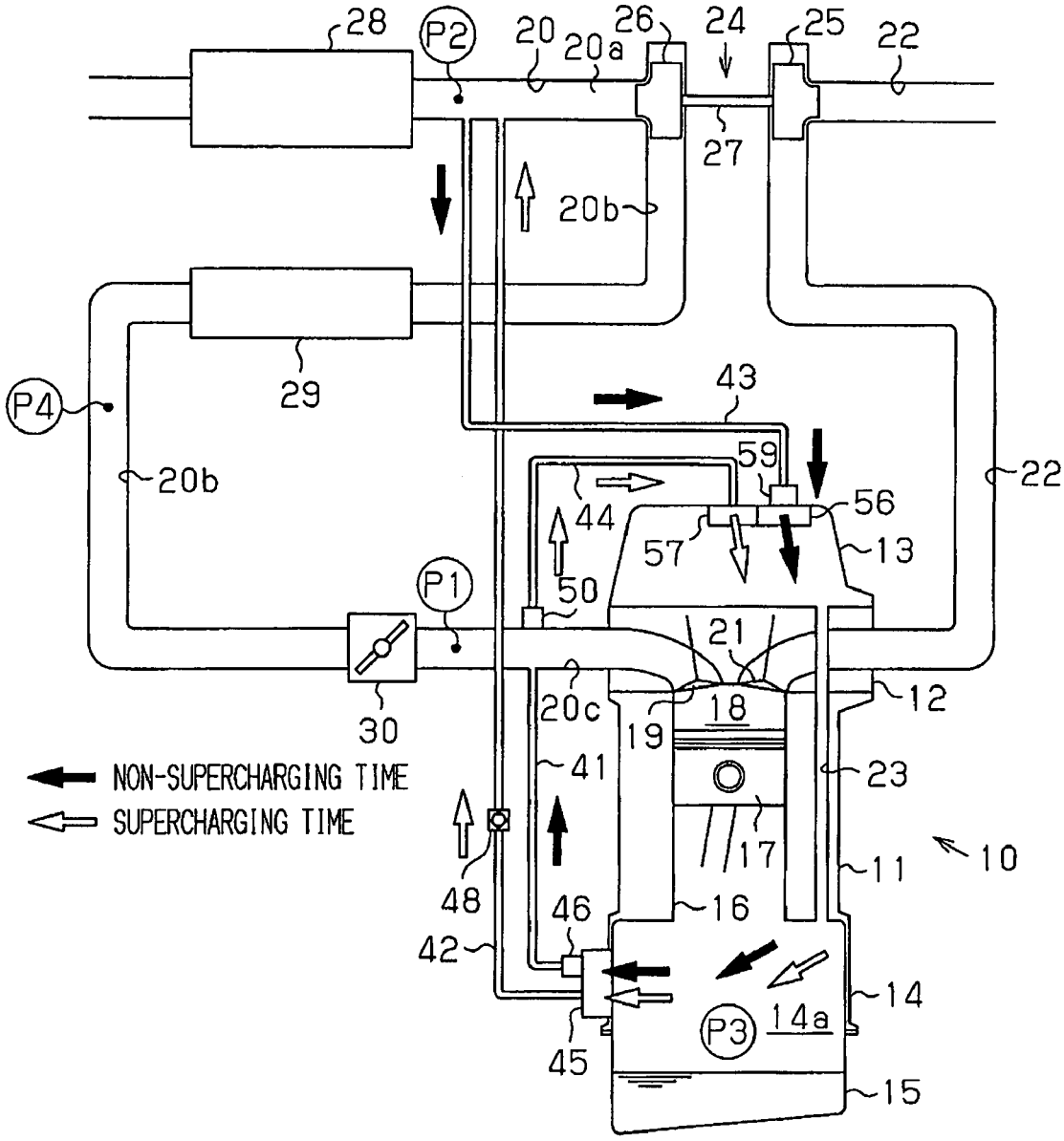
FIG. 3 is a schematic view of a blow-by gas processing apparatus in accordance with a third embodiment.

FIG. 3 shows a blow-by gas processing apparatus in accordance with a third embodiment of the present invention. The check valve 49 shown in FIG. 1 is deleted from the first introduction passage 43, and the first introduction passage 43 is provided with a throttle portion 59. The throttle portion 59 reduces a passage cross-sectional area of the first introduction passage 43. At the non-supercharging time, the first introduction passage 43 introduces the intake air to the interior of the head cover 13 from the intake passage 20 on the basis of the pressure difference between the downstream pressure P1 and the upstream pressure P2. At the supercharging time, the second introduction passage 44 introduces the intake air to the interior of the head cover 13 from the intake passage 20 on the basis of the pressure difference between the upstream pressure P2 and the downstream pressure P1.

As shown in FIG. 3, the second introduction passage 44 is provided with the second PCV valve 50 serving as the one-way introduction valve, however, the first introduction passage 43 is not provided with a one-way introduction valve. On the assumption that the throttle portion 59 does not exist, if the engine internal pressure P3 is higher than the upstream pressure P2 at the supercharging time, the gas in the engine 10 flows through the first introduction passage 43 so as to be unnecessarily discharged to the intake passage 20, on the basis of the pressure difference between the engine internal pressure P3 and the upstream pressure P2. As a result, the flowing direction of the blow-by gas in the engine 10, and the flowing direction of the intake air can be changed between the supercharging time and the non-supercharging time. In other words, the ventilating efficiency of the interior of the engine 10 can be lowered.

However, the throttle portion 59 in FIG. 3 suppresses the amount of the gas that flows through the first introduction passage 43 from the interior of the head cover 13 and is discharged. Accordingly, it is possible to substantially maintain the flowing direction of the blow-by gas in the engine 10 and the flowing direction of the intake air in the engine 10 without changing them between the supercharging time and the non-supercharging time.

Further, the third embodiment has the throttle portion 59 in place of the check valve 49. In other words, the third embodiment reduces one part which has a movable portion. Accordingly, it is possible to improve a reliability of the blow-by gas processing apparatus.

As shown in FIG. 3, the head cover 13 is provided with a first head oil separator 56, and a second head oil separator 57. The outlet of the first introduction passage 43 communicates with the interior of the head cover 13 via the first head oil separator 56. In other words, the first head oil separator 56 corresponds to a portion of the engine 10 communicating with the first introduction passage 43. The outlet of the second introduction passage 44 communicates with the interior of the head cover 13 via the second head oil separator 57.

On the assumption that the outlet of the first introduction passage 43, and the outlet of the second introduction passage 44 communicate with the interior of the head cover 13 via the common second oil separator 47, the outlet of the first introduction passage 43 can directly communicate with the outlet of the second introduction passage 44, in the second oil separator 47. Since the first introduction passage 43 is only provided with the throttle portion 59 in place of the check valve 49, the intake air in the second introduction passage 44 can flow into the first introduction passage 43, at the supercharging time.

However, in the case of FIG. 3, the intake air in the second introduction passage 44 passes through the path in the order of the outlet of the second introduction passage 44, the second head oil separator 57, the interior of the head cover 13, the first head oil separator 56, and the first introduction passage 43. Accordingly, it is possible to increase the resistance against the intake air flow by passing through the first head oil separator 56 and the second head oil separator 57 via the interior of the head cover 13. Therefore, it is possible to suppress a direct intake air flow from the outlet of the second introduction passage 44 to the outlet of the first introduction passage 43. As a result, it is easy to increase the intake air introducing amount from the second introduction passage 44 to the interior of the head cover 13. In other words, it is possible to improve the ventilating efficiency of the blow-by gas at the supercharging time.

Figure 4:
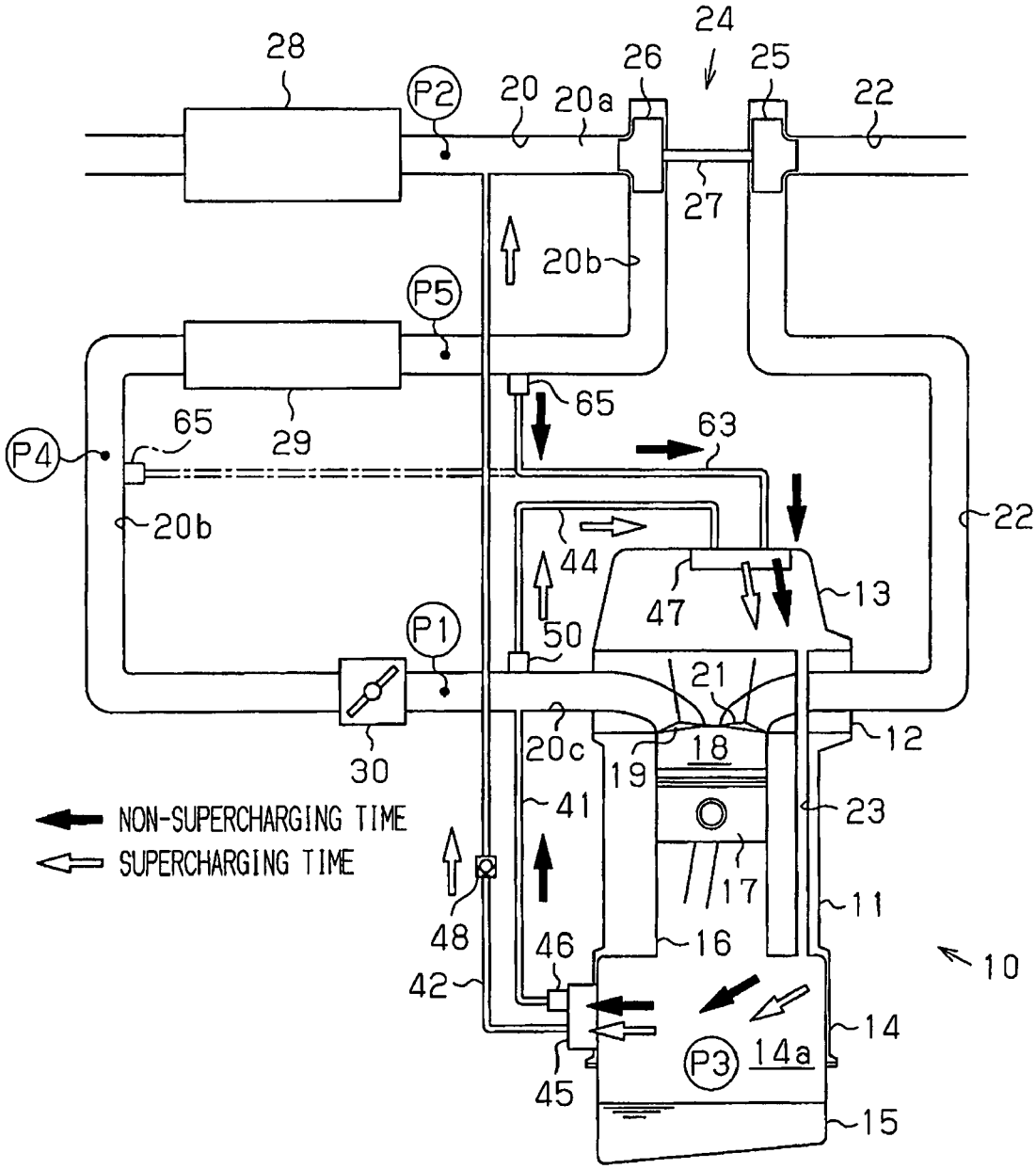
FIG. 4 is a schematic view of a blow-by gas processing apparatus in accordance with a fourth embodiment.

FIG. 4 shows a blow-by gas processing apparatus in accordance with a fourth embodiment of the present invention. The pressure in a section of the intake passage 20 between the intercooler 29 and the throttle valve 30 is referred to as a first intermediate pressure P4, and the pressure in a section of the intake passage 20 between the compressor impeller 26 and the intercooler 29 is referred to as a second intermediate pressure P5. A first introduction passage 43 shown in FIG. 1 is omitted, and the fourth embodiment has a first introduction passage 63. The first introduction passage 63 connects the intermediate portion 20*b* with the interior of the head cover 13. In other words, the first introduction passage 63 connects a portion between the supercharger 24 and the intercooler 29 with the interior of the head cover 13, in the intermediate portion 20*b*. The first introduction passage 63 is provided with a third PCV valve 65. The third PCV valve 65 corresponds to a differential pressure valve. In the case that the second intermediate pressure P5 is higher than the engine internal pressure P3, the more increased the pressure difference between them, the more reduced the opening degree of the third PCV valve 65 becomes. The third PCV valve 65 also corresponds to a first one-way introduction valve allowing only a gas introduction from the intermediate portion 20*b* to the interior of the head cover 13.

Further, as shown by a one-dot chain line in FIG. 4, an inlet of the first introduction passage 63 may communicate with the portion between the intercooler 29 and the throttle valve 30, in the intermediate portion 20*b*. In this case, when the first intermediate pressure P4 is higher than the engine internal pressure P3, the more increased the pressure difference between them, the more reduced the opening degree of the third PCV valve 65 becomes.

At the non-supercharging time, the downstream pressure P1 is lower than the upstream pressure P2 and the intermediate pressure P5 (or P4 in the case shown by a one-dot chain line in FIG. 4). Accordingly, the blow-by gas in the engine 10 flows through the first breather passage 41, and is discharged to the intake passage 20. The first introduction passage 63 introduces the intake air to the interior of the engine 10.

In the case shown in FIG. 4, a PCV valve may be provided in at least one of the first introduction passage 63 and the first breather passage 41. In the case that the first breather passage 41 is provided with the first PCV valve 46, the third PCV valve 65 may be omitted, and the first introduction passage 63 may be provided with a check valve. The check valve allows only the gas introduction from the intake passage 20 to the interior of the head cover 13. Further, in the case that the first introduction passage 63 is provided with the third PCV valve 65, the first PCV valve 46 may be omitted from the first breather passage 41, and the first breather passage 41 may be provided with a check valve. The check valve allows only the gas discharge from the crank chamber 14*a* to the intake passage 20.

In the case that the first introduction passage 63 is provided with a check valve, the first introduction passage 63 may be provided with an introduction limit valve. The introduction limit valve reduces the passage cross-sectional area of the first introduction passage 63 as the intermediate pressure P5 (or P4) is increased. The introduction limit valve inhibits the engine internal pressure P3 from being excessively increased due to the high intermediate pressure P5 (or P4), at the supercharging time. In other words, the introduction control valve suppresses the reduction of the reliability of the engine 10. The introduction limit valve may be structured such as to shut off the first introduction passage 63 in the case that the intermediate pressure P5 (or P4) is equal to or more than a predetermined pressure, or may be structured such as to gradually reduce the opening degree of the first introduction passage 63 as the intermediate pressure P5 (or P4) is increased.

The third PCV valve 65 shown in FIG. 4 may be omitted, and the first introduction passage 63 may be provided with a throttle portion. The throttle portion reduces the passage cross-sectional area of the first introduction passage 63. At the non-supercharging time, the throttle portion allows the intake air in the intermediate portion 20*b* to flow through the first introduction passage 63 so as to flow into the interior of the engine 10. At the supercharging time, the throttle portion inhibits the intake air in the intermediate portion 20*b* from flowing through the first introduction passage 63 so as to flow into the interior of the head cover 13. Accordingly, at the supercharging time, it is possible to inhibit the engine internal pressure P3 from being excessively increased due to the high intermediate pressure P5 (or P4).

Figure 5:
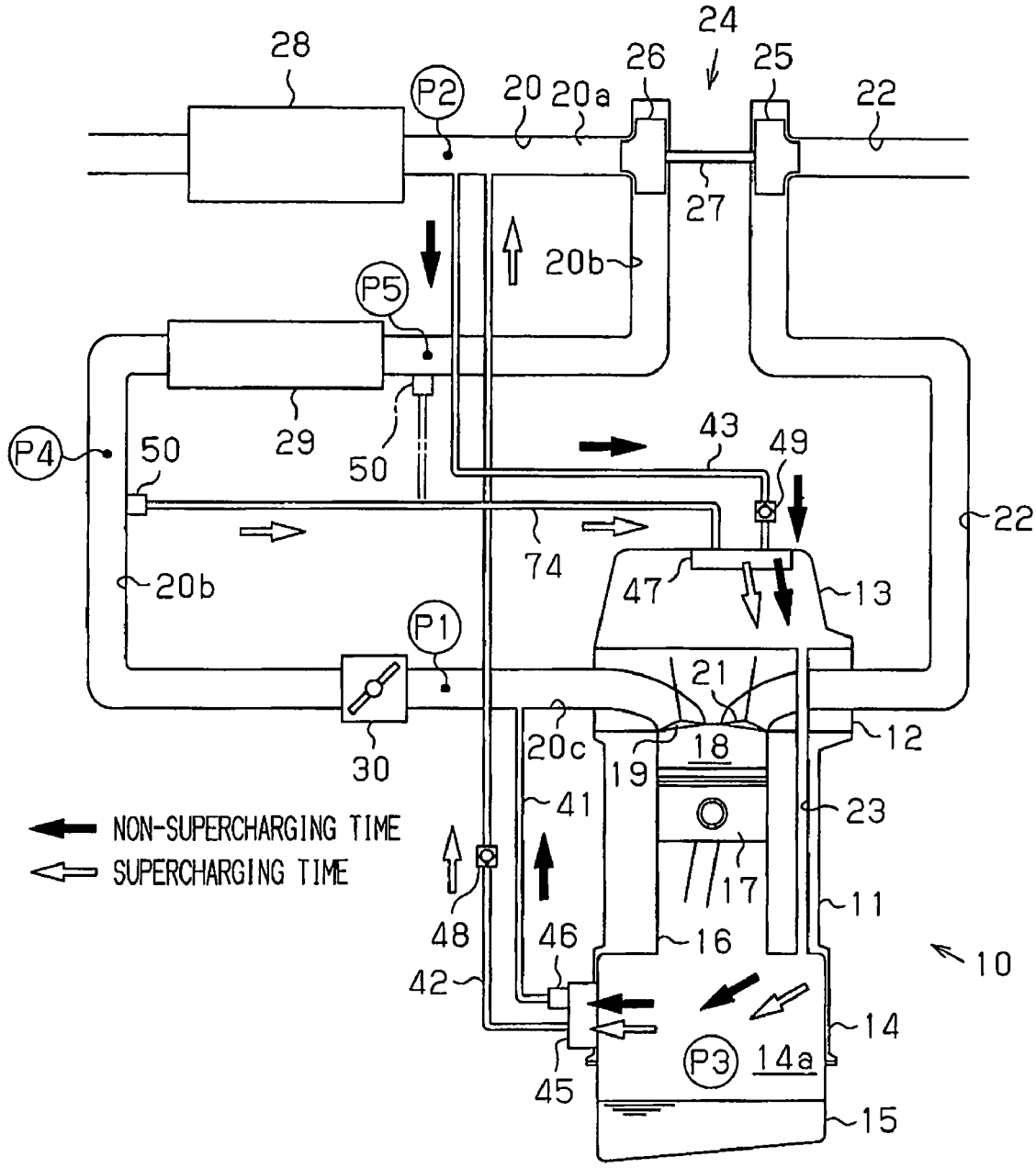
FIG. 5 is a schematic view of a blow-by gas processing apparatus in accordance with a fifth embodiment.

FIG. 5 shows a blow-by gas processing apparatus in accordance with a fifth embodiment of the present invention. The second introduction passage 44 shown in FIG. 1 is omitted. The fifth embodiment has a second introduction passage 74 connecting the intermediate portion 20*b* with the interior of the head cover 13. In other words, the second introduction passage 74 connects the portion between the intercooler 29 and the throttle valve 30 with the interior of the head cover 13, in the intermediate portion 20*b*. Further, as shown by a one-dot chain line in FIG. 5, an inlet of the second introduction passage 74 may communicate with the portion between the supercharger 24 and the intercooler 29, in the intermediate portion 20*b*. The second PCV valve 50 is arranged in the second introduction passage 74.

At the supercharging time, the upstream pressure P2 is lower than the intermediate pressure P4 (or P5) (P2<P4 (or P5)). Accordingly, the pressure difference between the intermediate pressure P4 (or P5) and the upstream pressure P2 introduces the intake air in the second introduction passage 74 into the interior of the engine 10, and discharges the blow-by gas in the engine 10 from the second breather passage 42 to the intake passage 20.

In the case shown in FIG. 5, the structure is not limited to such a structure that the second introduction passage 74 is provided with the second PCV valve 50, and the second breather passage 42 is provided with the first check valve 48. The PCV valve may be provided in at least one of the second introduction passage 74 and the second breather passage 42. For example, the second introduction passage 74 may be provided with a check valve, and the second breather passage 42 may be provided with a PCV valve. The check valve allows only the gas introduction from the intake passage 20 to the interior of the head cover 13. The PCV valve allows only the gas discharge from the crank chamber 14*a* to the intake passage 20. Further, the second introduction passage 74 may be provided with the second PCV valve 50, and the second breather passage 42 may be provided with a PCV valve.

In the case that the second introduction passage 74 is provided with a check valve, the second introduction passage 74 may be provided with an introduction limit valve. The introduction limit valve reduces the passage cross-sectional area of the second introduction passage 74 as the intermediate pressure P4 (or P5) is increased. The introduction limit valve can suppress the engine internal pressure P3 from being excessively increased due to the high intermediate pressure P4 (or P5), at the supercharging time. In other words, it is possible to suppress the reduction of the reliability of the engine 10. The introduction limit valve may be structured such as to shut off the second introduction passage 74 in the case that the intermediate pressure P4 (or P5) is equal to or more than a predetermined pressure, or may be structured such as to gradually reduce the opening degree of the second introduction passage 74 as the intermediate pressure P4 (or P5) is increased.

The check valve 49 may be omitted from the first introduction passage 43, and the first introduction passage 43 may be provided with a throttle portion. The throttle portion reduces the passage cross-sectional area of the first introduction passage 43. The throttle portion allows the intake air introduction from the intake passage 20 to the interior of the head cover 13, on the basis of the pressure difference between the downstream pressure P1 and the upstream pressure P2, at the non-supercharging time. The second introduction passage 74 introduces the intake air from the intake passage 20 to the interior of the head cover 13, on the basis of the pressure difference between the intermediate pressure P4 (or P5) and the downstream pressure P1, at the supercharging time. The throttle portion suppresses the amount of the gas flowing through the first introduction passage 43 from the interior of the head cover 13 so as to be discharged to the intake passage 20. Accordingly, the flowing direction of the blow-by gas in the engine 10, and the flowing direction of the intake air are substantially constant without being changed. Further, in order to set the throttle portion in place of the check valve 49, in the first introduction passage 43, it is possible to reduce one part having a movable portion. Accordingly, it is possible to improve the reliability of the blow-by gas processing apparatus.

In the case of FIG. 5, it is preferable that the head cover 13 is provided with the same first head oil separator 56 and second head oil separator 57 as those in FIG. 3. The outlet of the first introduction passage 43 communicates with the interior of the head cover 13 via the first head oil separator 56. The outlet of the second introduction passage 74 communicates with the interior of the head cover 13 via the second head oil separator 57. As a result, it is possible to inhibit the intake air from flowing from the outlet of the second introduction passage 74 to the outlet of the first introduction passage 43. In other words, it is possible to increase the intake air introduction amount from the outlet of the second introduction passage 74 to the interior of the head cover 13, and it is possible to improve the ventilating efficiency of the blow-by gas at the supercharging time.

Figure 6:
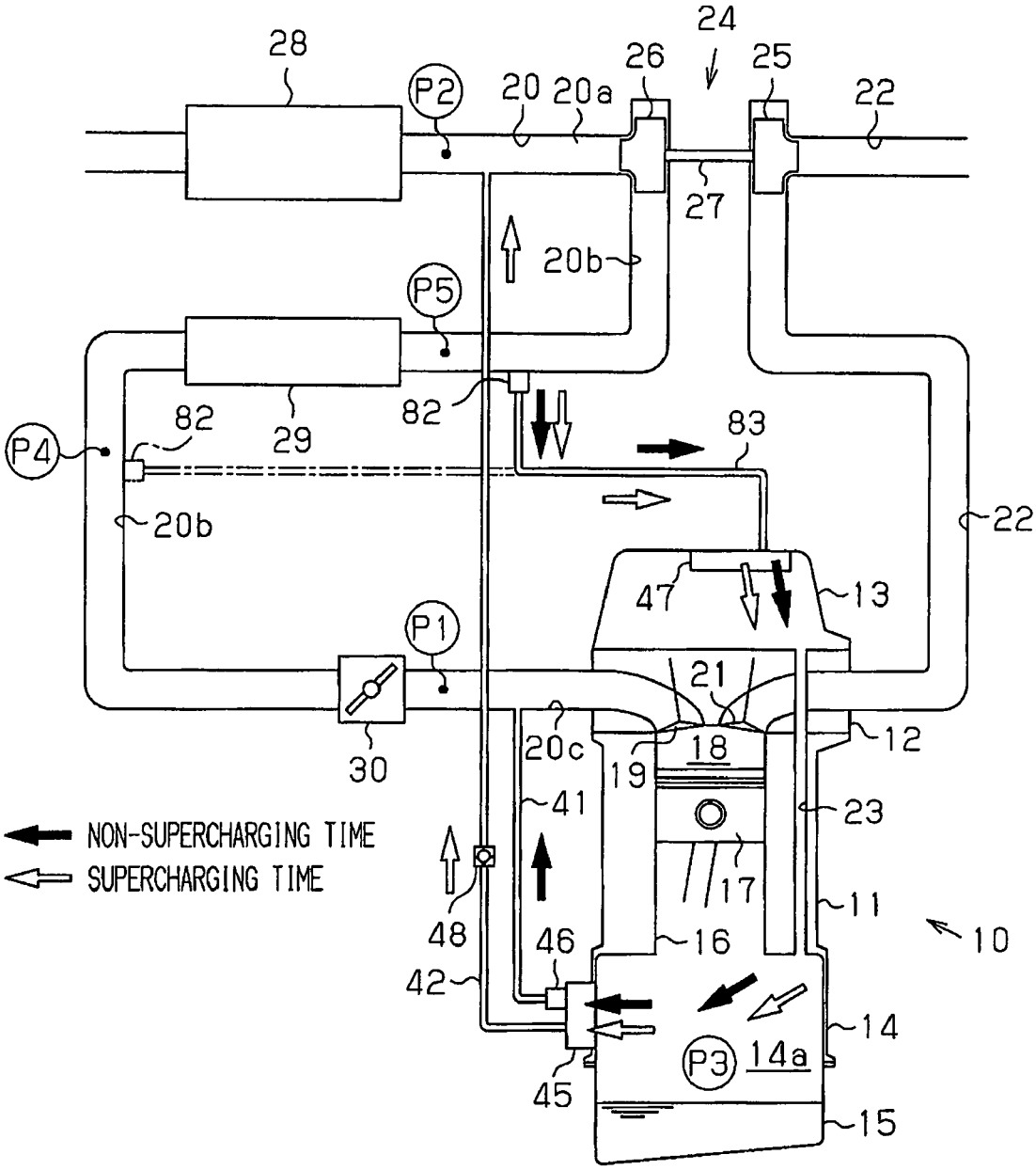
FIG. 6 is a schematic view of a blow-by gas processing apparatus in accordance with a sixth embodiment.

FIG. 6 shows a sixth embodiment according to the present invention. The sixth embodiment has a common introduction passage 83. The first introduction passage 43 and the second introduction passage 44 shown in FIG. 1 are omitted. The common introduction passage 83 connects the intermediate portion 20*b* with the interior of the head cover 13. In other words, an inlet of the common introduction passage 83 communicates with the portion between the supercharger 24 and the intercooler 29, in the intermediate portion 20*b*. As shown by a one-dot chain line in FIG. 6, the inlet of the common introduction passage 83 may communicate with the portion between the intercooler 29 and the throttle valve 30, in the intermediate portion 20*b*.

At the non-supercharging time, the intermediate pressure P5 (or P4) serving as the introduction portion pressure is higher than the downstream pressure P1 (P1<P5 (or P4)). Accordingly, at the non-supercharging time, the common introduction passage 83 can introduce the intake air in the intermediate portion 20*b* to the interior of the head cover 13, on the basis of the pressure difference between the intermediate pressure P5 (or P4) and the downstream pressure P1. At the supercharging time, the intermediate pressure P5 (or P4) is higher than the upstream pressure P2. Accordingly, at the supercharging time, the common introduction passage 83 can introduce the intake air in the intermediate portion 20*b* to the interior of the head cover 13 on the basis of the pressure difference between the intermediate pressure P5 (or P4) and the upstream pressure P2.

As shown in FIG. 6, the common introduction passage 83 may be provided with the introduction limit valve 82. The introduction limit valve 82 reduces the passage cross-sectional area of the common introduction passage 83 if the intermediate pressure P5 (or P4) is increased. In other words, the introduction limit valve 82 corresponds to a differential pressure valve. In the case that the intermediate pressure P5 (or P4) is higher than the engine internal pressure P3, an opening degree of the introduction limit valve 82 is reduced as the pressure difference between these pressures is increased. The introduction limit valve 82 can inhibit the engine internal pressure P3 from being excessively increased due to the high intermediate pressure P5 (or P4), at the supercharging time. Accordingly, it is possible to suppress the reduction of the reliability of the engine 10. The introduction limit valve 82 may be structured such as to shut off the common introduction passage 83 in the case that the intermediate pressure P5 (or P4) is equal to or higher than a predetermined pressure, or may be structured such as to gradually reduce the opening degree of the common introduction passage 83 as the intermediate pressure P5 (or P4) is increased.

In this case, if there is no risk that the engine internal pressure P3 becomes excessively higher at the supercharging time, the introduction limit valve 82 shown in FIG. 6 may be omitted.

The first breather passage 41 shown in FIG. 6 may be provided with a check valve. The check valve allows only the gas discharge from the crank chamber 14*a* to the intake passage 20. Further, the second breather passage 42 shown in FIG. 6 may be provided with a PCV valve. The PCV valve allows only the gas discharge from the crank chamber 14*a* to the intake passage 20.

The introduction limit valve 82 shown in FIG. 6 may be omitted, and the common introduction passage 83 may be provided with a throttle portion. The throttle portion reduces the passage cross-sectional area of the common introduction passage 83. The throttle portion allows the intake air in the intake passage 20 to flow through the common introduction passage 83 so as to flow into the interior of the head cover 13, at the non-supercharging time. The throttle portion inhibits the intake air in the intake passage 20 from flowing through the common introduction passage 83 so as to excessively flow into the interior of the head cover 13, at the supercharging time. Accordingly, the throttle portion can inhibit the engine internal pressure P3 from being excessively increased due to the internal pressure P5 (or P4), at the supercharging time.

The various PCV valves and check valves mentioned above may be replaced by electromagnetic control valves. An opening degree of the electromagnetic control valve is controlled on the basis of the engine internal pressure P3, or the pressure (P1, P2, P5 (or P4)) of the intake passage 20.

Figure 7:
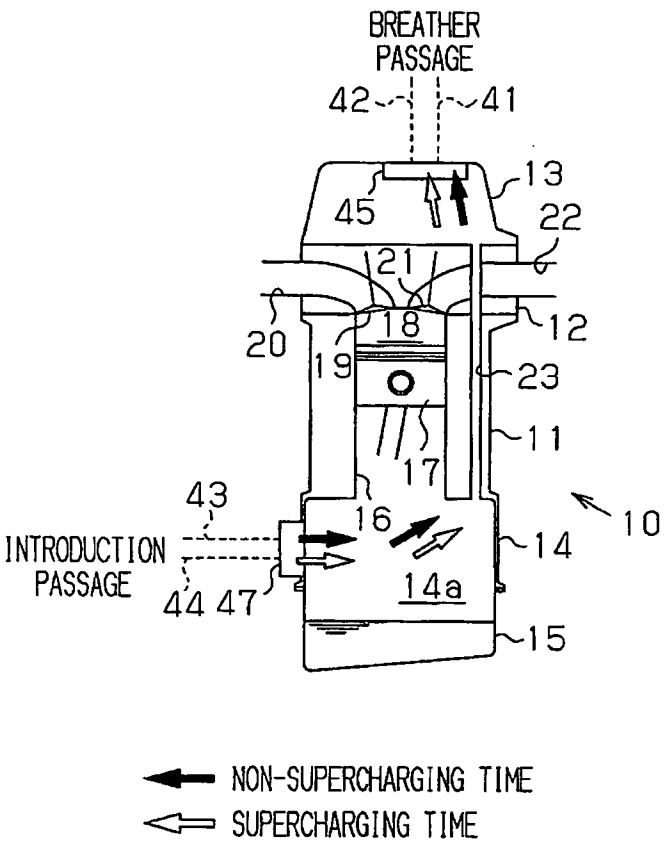
FIG. 7 is a schematic view of a blow-by gas processing apparatus in accordance with a modified embodiment.

As shown in FIG. 7, the first oil separator 45 may be arranged in the head cover 13, and the second oil separator 47 may be arranged in the crankcase 14. In other words, the inlet of the first breather passage 41, and the inlet of the second breather passage 42 are connected to the head cover 13 via the second oil separator 47. The outlet of the first introduction passage 43 and the outlet of the second introduction passage 44 are connected to the crank chamber 14*a* via the first oil separator 45.

Figure 8B:
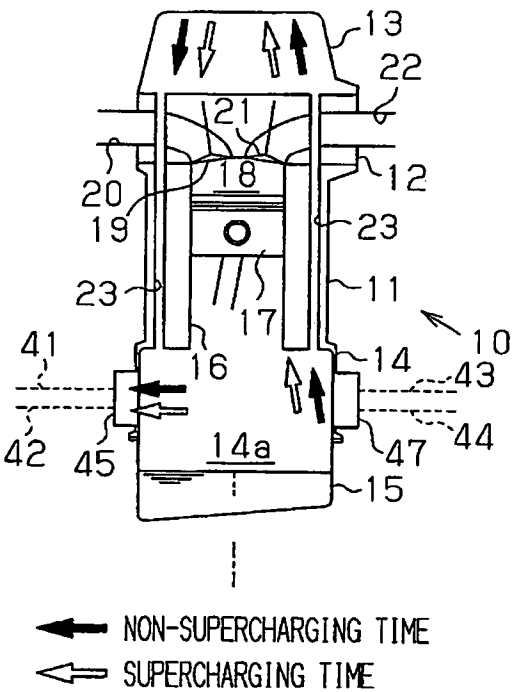
FIGS. 8A and 8B are schematic views of blow-by gas processing apparatuses in accordance with different modified embodiment.
Figure 8A:
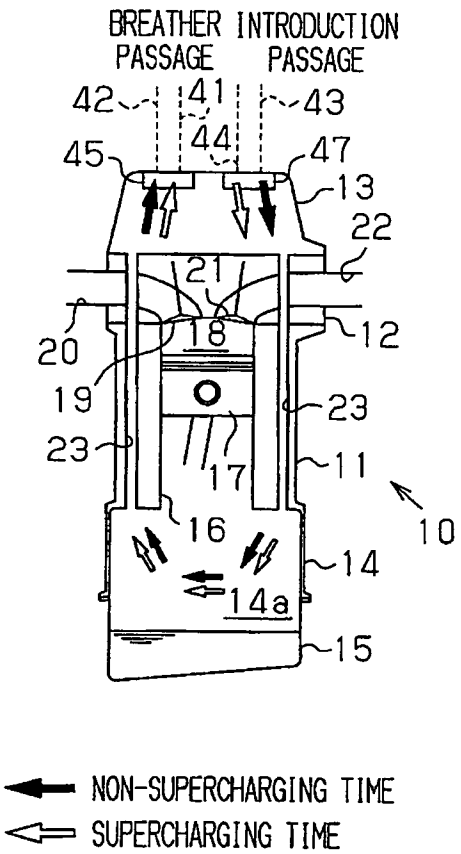

As shown in FIG. 8A, both of the first oil separator 45 and the second oil separator 47 may be arranged in the head cover 13. The inlet of the first oil separator 45 and the inlet of the second oil separator 47 are connected to the head cover 13 via the first oil separator 45. The outlet of the first introduction passage 43 and the outlet of the second introduction passage 44 are connected to the head cover via the second oil separator 47. In this case, it is desirable to devise the shape of the communicating passage 23 in such a manner as to smoothly execute the blow-by gas introduction from the crank chamber 14*a* to the interior of the head cover 13, and the intake air introduction from the interior of the head cover 13 to the crank chamber 14*a*. For example, the number of the communicating passages 23 may be set to two, and the communicating passages 23 may be arranged on a diagonal line of the cylinder block 11.

As shown in FIG. 8B, both of the first oil separator 45 and the second oil separator 47 may be arranged in the crankcase 14. The first oil separator 45 and the second oil separator 47 are arranged at different positions from each other in the crank chamber 14*a*. The outlet of the first introduction passage 43 and the outlet of the second introduction passage 44 are connected to the crank chamber 14*a* via the second oil separator 47. The inlet of the first breather passage 41 and the inlet of the second breather passage 42 are connected to the crank chamber 14*a* via the first oil separator 45.

If it is possible to avoid the oil intrusion from the interior of the engine 10 to the first breather passage 41 and the second breather passage 42, the first oil separator 45 may be omitted. Further, if it is possible to avoid the oil intrusion from the interior of the engine 10 to the first introduction passage 43 or the second introduction passage 44, the second oil separator 47 may be omitted.

Figure 9:
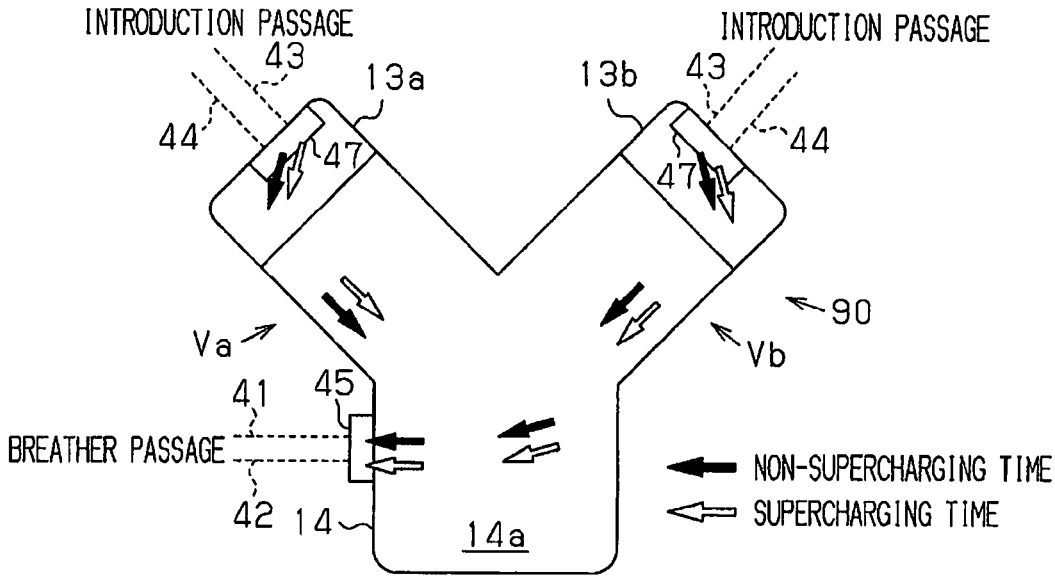
FIG. 9 is a schematic view of a blow-by gas processing apparatus in accordance with further another modified embodiment.

As shown in FIG. 9, the blow-by gas processing apparatus may be applied to a V engine 90 having cylinders arranged to form the letter V. The outlet of the first introduction passage 43 and the outlet of the second introduction passage 44 are connected to a left head cover 13*a* provided in a left bank Va. The outlet of the first introduction passage 43 and the outlet of the second introduction passage 44 are connected to a right head cover 13*b* provided in a right bank Vb, in the same manner. The inlet of the first breather passage 41 and the inlet of the second breather passage 42 are connected to one crankcase 14.

Figure 10:
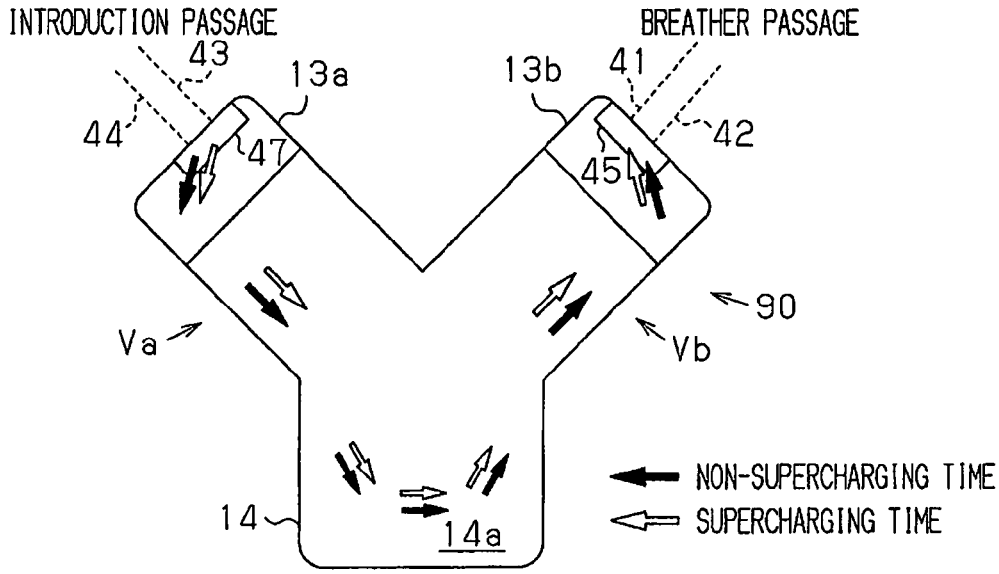
FIG. 10 is a schematic view of a blow-by gas processing apparatus in accordance with further another modified embodiment.

As shown in FIG. 10, the outlet of the first introduction passage 43 and the outlet of the second introduction passage 44 may be connected to the left head cover 13*a*. The inlet of the first breather passage 41 and the inlet of the second breather passage 42 are connected to the right head cover 13*b*.

Figure 11:
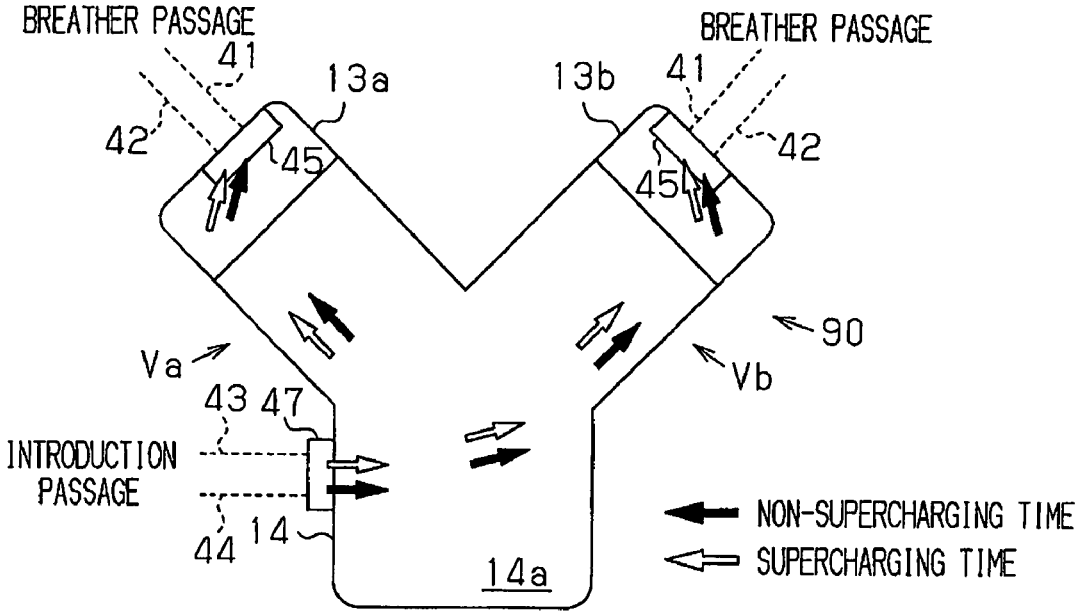
FIG. 11 is a schematic view of a blow-by gas processing apparatus in accordance with further another modified embodiment.
Figure 12:
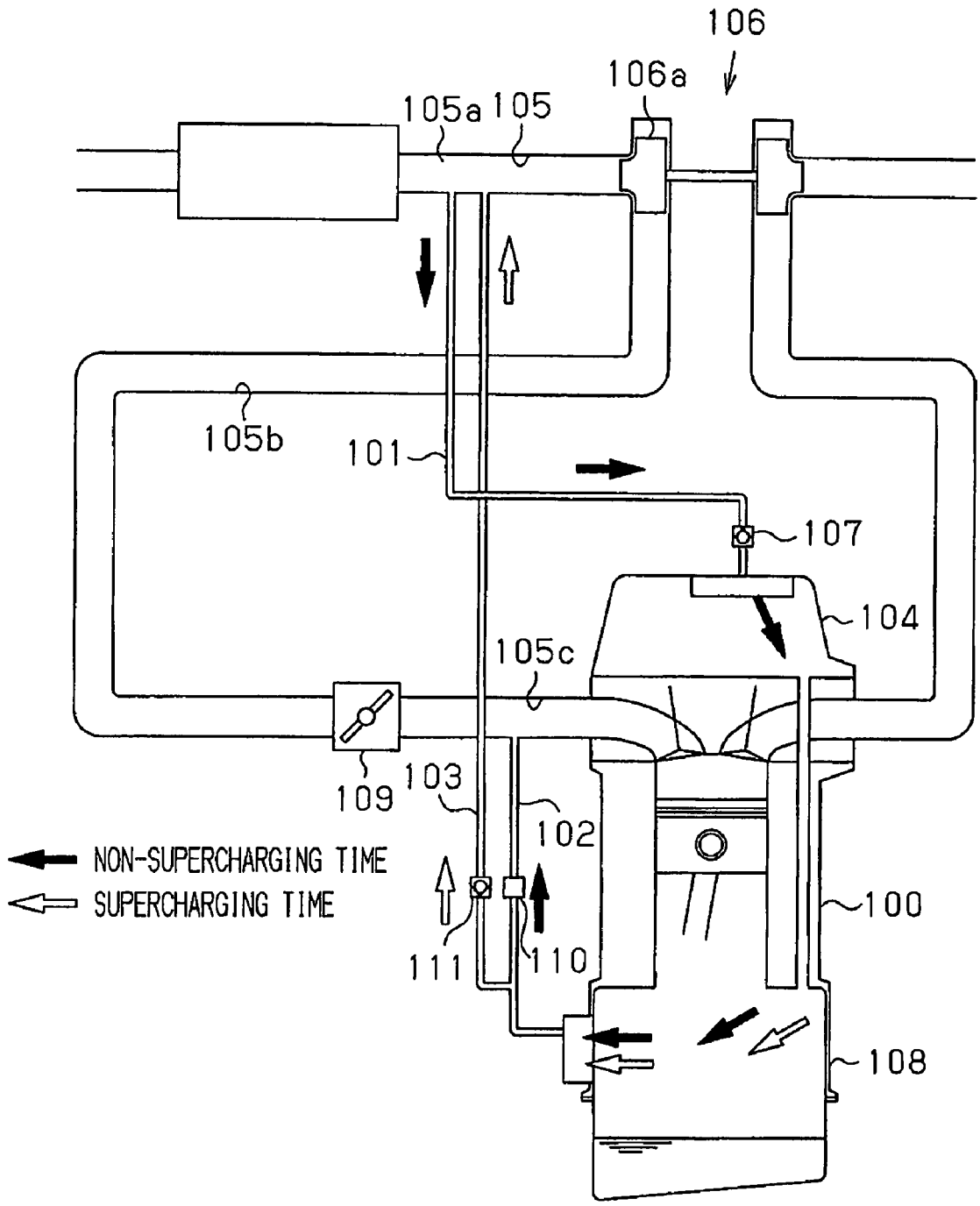
Fig.12(Prior Art)
FIG. 12 is a schematic view of a prior art blow-by gas processing apparatus.
Figure 13:
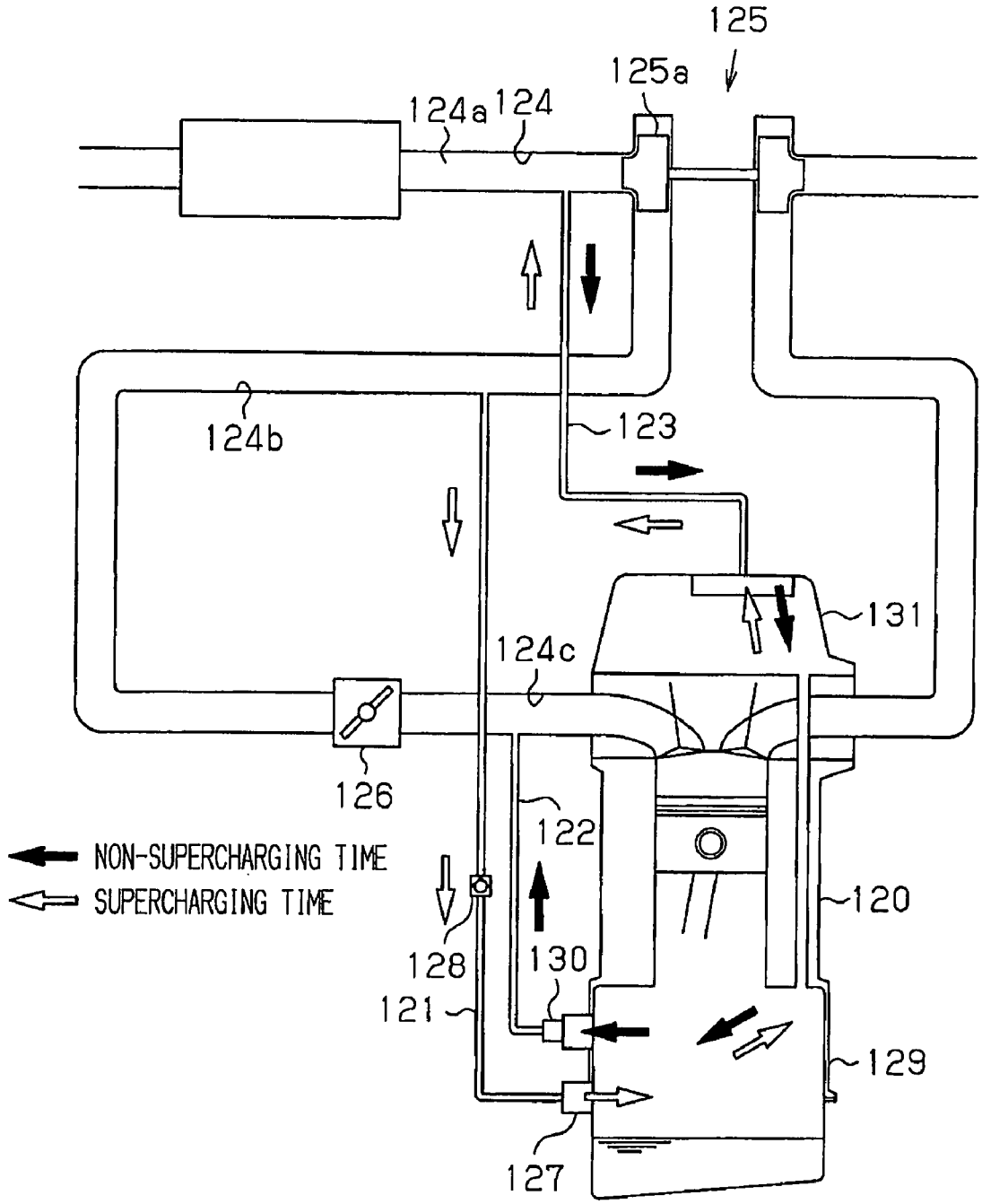
Fig.13(Prior Art)
FIG. 13 is a schematic view of another prior art blow-by gas processing apparatus.
Figure 14:
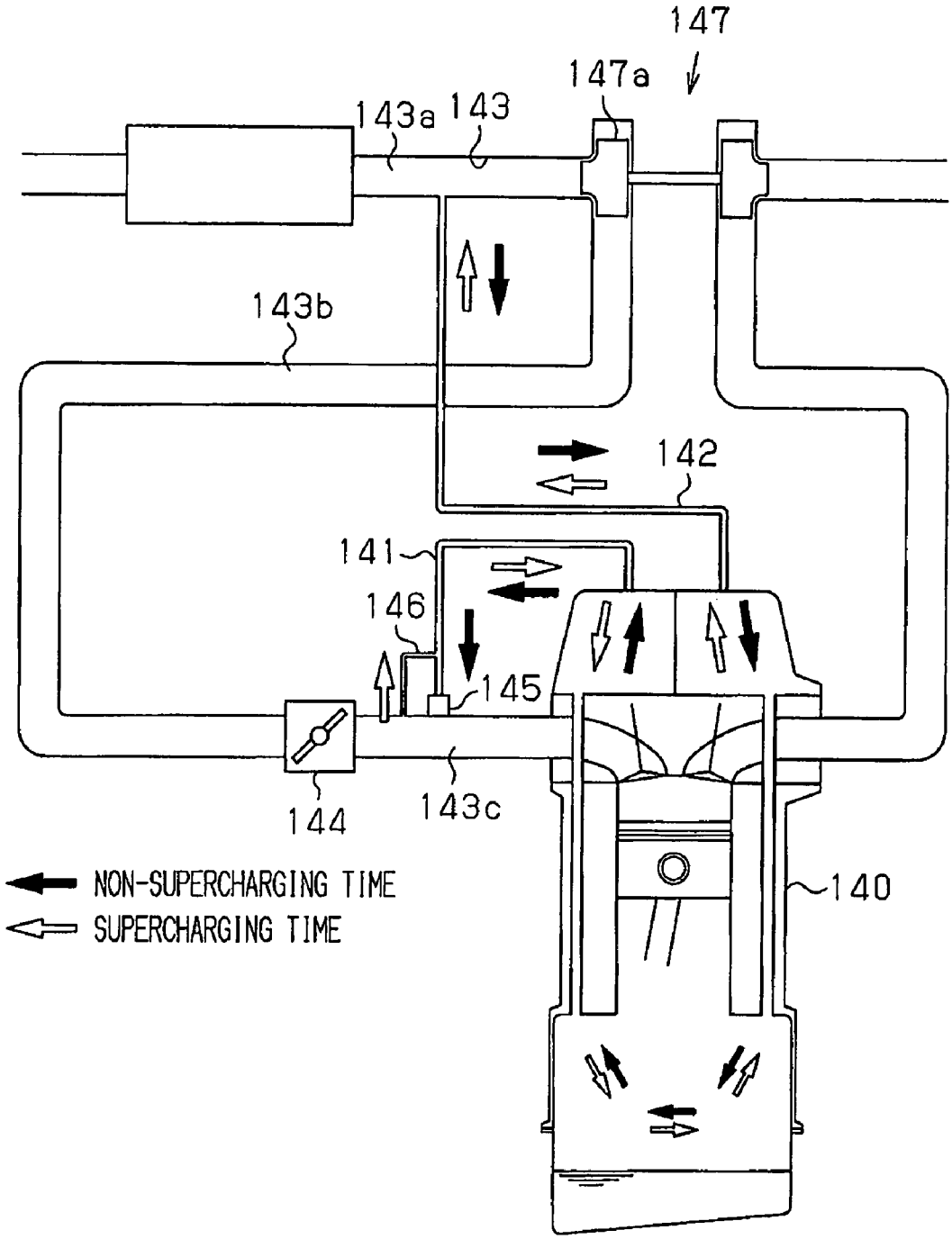
Fig.14(Prior Art)
FIG. 14 is a schematic view of another prior art blow-by gas processing apparatus.

As shown in FIG. 11, the outlet of the first introduction passage 43 and the outlet of the second introduction passage 44 may be connected to one crankcase 14. The inlet of the first breather passage 41 and the inlet of the second breather passage 42 are connected to the left head cover 13*a*. In the same manner, the inlet of the first breather passage 41 and the inlet of the second breather passage 42 are connected to the right head cover 13*b*.

The blow-by gas processing apparatuses shown in FIGS. 7 to 11 each introduce the intake air in the intake passage 20 to the interior of the engine 10 at both of the supercharging time and the non-supercharging time, as shown by the filled-in arrows and the open arrows. Further, the blow-by gas in the engine 10 is recirculated to the intake passage 20. Further, the flowing direction of the blow-by gas in the engine 10, and the flowing direction of the intake air in the engine 10 are substantially constant.

The supercharger 24 provided in the engine 10 is not limited to the exhaust-driven type, but may be structured as an engine driven type. Further, the intake passage 20 to the intercooler 29 may be omitted. The blow-by gas processing apparatus in accordance with the present invention may be applied to the engine 10 in these cases.

The invention claimed is:

1. A blow-by gas processing apparatus applicable to an internal combustion engine, wherein an intake passage extends from the engine, an intake air flows through the intake passage from an upstream side to a downstream side, whereby the intake air flows toward the engine, a supercharger and a throttle valve are arranged in the intake passage, the throttle valve is positioned in a downstream side of the supercharger, the supercharger pressure feeds the intake air flowing through the intake passage toward the engine, thereby supercharging the intake air to the engine, the throttle valve variably sets a passage cross-sectional area of the intake passage, and the intake passage has an upstream portion in an upstream side of the supercharger, an intermediate portion between the supercharger and the throttle valve, and a downstream portion in a downstream side of the throttle valve, the processing apparatus comprising:

a first breather passage connecting an interior of the engine with the downstream portion, the first breather passage communicating with the interior of the engine in a first communicating portion, and the first breather passage having a one-way discharge valve allowing only a gas discharge from the interior of the engine to the intake passage;

a second breather passage connecting the interior of the engine with the upstream portion, the second breather passage communicating with the interior of the engine in the first communicating portion, and the second breather passage having a second one-way discharge valve allowing only a gas discharge from the interior of the engine to the upstream portion; and an introduction passage connecting the upstream portion with the interior of the engine at a non-supercharging time, and the introduction passage connecting at least one of the intermediate portion and the downstream portion with the interior of the engine at a supercharging time.

2. The processing apparatus according to claim 1, wherein the introduction passage includes a first introduction passage and a second introduction passage, wherein the first introduction passage has a first one-way introduction valve allowing only a gas introduction from the intake passage to the interior of the engine, the first introduction passage connects at least one of the upstream portion and the intermediate portion with the interior of the engine, and the first introduction passage communicates with the interior of the engine in a second communicating portion, and wherein the second introduction passage has a second one-way introduction valve allowing only a gas introduction from the intake passage to the interior of the engine, and the second introduction passage connects at least one of the intermediate portion and the downstream portion with the second communicating portion.

3. The processing apparatus according to claim 2, wherein the first introduction passage connects the upstream portion with the second communicating portion, and wherein the second introduction passage connects the downstream portion with the second communicating portion.

4. The processing apparatus according to claim 3, wherein the second one-way introduction valve is a differential pressure valve, and an opening degree of the second one-way introduction valve is changed in correspondence to a pressure difference between the interior of the engine and the intake passage.

5. The processing apparatus according to claim 3, wherein the first one-way discharge valve is a differential pressure valve, and an opening degree of the first one-way discharge valve is increased as a pressure difference between the interior of the engine and the intake passage is reduced.

6. The processing apparatus according to claim 3, wherein each of the first one-way introduction valve and the second one-way discharge valve is a check valve.

7. The processing apparatus according to claim 1, wherein the introduction passage connects the intermediate portion with the interior of the engine.

8. The processing apparatus according to claim 7, wherein the introduction passage has a differential pressure valve, and an opening degree of the differential pressure valve is changed in correspondence to the pressure difference between the interior of the engine and the intake passage.

9. The processing apparatus according to claim 7, wherein the first one-way discharge valve is a differential pressure valve, and an opening degree of the first one-way discharge valve is increased as the pressure difference between the interior of the engine and the intake passage is reduced.

10. The processing apparatus according to claim 7, wherein the second one-way discharge valve is a check valve.

11. The processing apparatus according to claim 1, wherein the introduction passage includes a first introduction passage and a second introduction passage, wherein the first introduction passage has a throttle portion having a reduced passage cross-sectional area, the first introduction passage connects the upstream portion with the interior of the engine, and the first introduction passage communicates with the interior of the engine in a second communicating portion, wherein the second introduction passage has a one-way introduction valve allowing only a gas introduction from the intake passage to the interior of the engine, and the second introduction passage connects at least one of the intermediate portion and the downstream portion with the second communicating portion.

12. The processing apparatus according to claim 11, wherein the second introduction passage connects the downstream portion with the communicating portion.

13. The processing apparatus according to claim 11, wherein the one-way introduction valve is a differential pressure valve, and an opening degree of the one-way introduction valve is changed in correspondence to the pressure difference between the interior of the engine and the intake passage.

14. The processing apparatus according to claim 11, wherein the first one-way discharge valve is a differential pressure valve, and an opening degree of the first one-way discharge valve is increased as the pressure difference between the interior of the engine and the intake passage is reduced.

15. The processing apparatus according to claim 11, further comprising a first oil separator and a second oil separator each provided in the engine, wherein the first introduction passage communicates with the interior of the engine-via the first oil separator, and wherein the second introduction passage communicates with the interior of the engine via the second oil separator.

* * * * *